US005232662A

United States Patent [19]

Culling

[11] Patent Number: 5,232,662

[45] Date of Patent: Aug. 3, 1993

[54] HEAT-RESISTANT CORROSION-RESISTANT SUPERALLOYS

[75] Inventor: John H. Culling, St. Louis, Mo.

[73] Assignee: Carondelet Foundry Company, St. Louis, Mo.

[21] Appl. No.: 930,102

[22] Filed: Aug. 13, 1992

[51] Int. Cl.[5] ..... C22C 30/00

[52] U.S. Cl. ..... 420/586

[58] Field of Search ..... 420/586

[56] References Cited

U.S. PATENT DOCUMENTS 5,077,006 12/1991 Culling ..... 420/584.1

OTHER PUBLICATIONS

Multimet Alloy (product description) Haynes Stellite Company, pp. 1–27 (1960), plus 5 additional miscellanious pages.

High Temperature Property Data: Ferrous Alloys, ASM International (1988).

*Primary Examiner*—Deborah Yee

*Attorney, Agent, or Firm*—Senniger, Powers, Leavitt & Roedel

[57] ABSTRACT

A superalloy having improved hot strength at temperatures above about 1600° F. The superalloy contains about 18–29% Ni by weight, 14–24% Co, 22–28% Cr, 0.25–0.8% W, 0.25–0.7% Cb, 0.12–0.55% C, and 0.05–0.35% Ti. Molybdenum content is maintained low but is tolerated up to about 0.8%.

19 Claims, No Drawings

HEAT-RESISTANT CORROSION-RESISTANT SUPERALLOYS

FIELD OF THE INVENTION

This invention relates to heat-resistant, corrosion-resistant nickel-chromium-cobalt superalloys which are also resistant to thermal fatigue and shock. The alloys of the invention have high hot strength and long service life in corrosive gases, including gases high in sulfur products, up to very high temperatures. These alloys have excellent weldability, fabricability and machinability.

BACKGROUND OF THE INVENTION

Jet engine components and other structural components used in high temperature applications generally require the use of alloys possessing high hot strength, excellent weldability, machinability, fabricability and resistance to failure by thermal shock or thermal fatigue. Over a period of several decades service performance requirements for jet engines and their components, in particular, have increased. For example, a comparison of aircraft engines in service today with those at the beginning of the jet age indicates that thrust-to-weight ratios have tripled, the time between overhauls has been increased over a hundredfold, and turbine inlet temperatures have increased from less than 1500° F. to greater than 2000° F. These factors have drastically increased the service requirements of jet engine component materials.

Jet engine components have been manufactured from cobalt-base superalloys containing about 40% to 63% Co plus Cr, less than about 3% Fe and large amounts of such elements as Mo, W, Cb and Ta and up to about 30% Ni. Other cobalt-containing superalloys have been developed around a base of typically 50% to 75% Ni, about 10% to 20% Co, 10% to 20% Cr, plus Ti and/or Al along with elements from the Mo, W, Cb and Ta group and less than about 7% Fe. As these alloys contain significant quantities of the moderately scarce elements nickel and cobalt, much development effort has centered around the series of heat-resistant, corrosion-resistant superalloys containing about 18% or more iron as a partial replacement for nickel and cobalt.

Among the specific factors of concern in the development of alloys for use in jet engine and other high-temperature environments is the increasing use of fuels high in sulfur, sodium and vanadium. As service temperatures have climbed, the use of these fuels has significantly increased the risks of failure due to hot gas corrosive attack. For example, sulfur and sulfur-containing compounds in jet engine gases contacting the surface of high molybdenum content alloys may disadvantageously result in the formation of low melting point sulfides. These sulfides tend to flux away the protective chromium oxide coating of these alloys.

In Table I are listed the compositions of two series of experimental alloys previously introduced for use in high-temperature, corrosive environments, in particular, for service in gas turbine rotors, shafts, blades, buckets, bolts, tailpipes, tail cones, afterburner parts, exhaust manifolds, combustion chambers, waste heat boilers, incinerators, industrial fans, furnace hardware and structures.

TABLE I

| ALLOY DESIGNATION | NOMINAL CONTENT OF MAJOR ELEMENTS, WEIGHT % | | | | | | | |
|---|---|---|---|---|---|---|---|---|
| | Ni | Co | Cr | Mo | W | Cb | N | Fe |
| S-495 | 20 | — | 15 | 4 | 4 | 4 | — | 50 |
| S-588 | 20 | — | 18.5 | 4 | 4 | 4 | — | 47 |
| S-497 | 20 | 20 | 15 | 4 | 4 | 4 | — | 31 |
| S-590 | 20 | 20 | 20 | 4 | 4 | 4 | — | 25 |
| S-816 | 20 | 45 | 20 | 4 | 4 | 4 | — | 4 |
| N-153 | 15 | 13 | 16 | 3 | 2.2 | 1 | 0.07 | 47 |
| N-154 | 24 | 21 | 16 | 3 | 2.2 | 1 | 0.07 | 30 |
| N-156 | 33 | 24 | 16 | 3 | 2.2 | 1 | 0.04 | 18 |
| N-155 | 20 | 20 | 21 | 3 | 2.5 | 1 | 0.15 | 30 |

The only alloys of this group believed to have achieved significant use and which remain available are S-590, S-816 and N-155.

Of these alloys, S-590 and N-155 have been indicated to be useful for moderate stress applications and for intermittent service up to about 1900° F. However, both S-590 and N-155 begin to corrode rapidly in oxidizing combustion gases at temperatures over 1600° to 1650° F., and are very rapidly attacked above 1650° F. in the presence of gases containing sulfur or sulfur products. Despite the fact that the S-590 alloy contains almost twice the total content of three elements thought to improve hot strength, molybdenum, tungsten and columbium, as compared to N-155, the hot strengths of S-590 and N-155 are very nearly equal at temperatures between 1200° F. and 1800° F. Additionally, the presence of the strong ferrite formers, molybdenum, tungsten and columbium, in the fairly large amounts of S-590 and N-155, tends to limit the level of chromium that may be present while retaining the very important stable austenitic matrix structure. Accordingly, if one increases the chromium content of this type of alloy in order to increase hot corrosion resistance, one must either increase nickel and/or cobalt content, increase carbon content, or decrease the total content of the strengthening elements such as molybdenum, tungsten and columbium in order to avoid the risk of ferrite formation. However, it is economically undesirable to increase nickel or cobalt content, and increasing carbon content may nullify other desirable properties of this type of alloy. It is also desirable to significantly reduce or remove molybdenum from these alloys type for even further enhancement of hot corrosion resistance, such as in the presence of sulfur gases or compounds. It remains desirable, therefore, to increase chromium content by some method superior to those methods described hereinabove, and to do so without loss of hot strength.

Of the alloys of Table I, S-816 has by far the highest combined nickel and cobalt content and would therefore be expected to be the most expensive. S-816 is therefore employed only in relatively small amounts as compared to other heat-resistant superalloys. Additionally, S-816 is less ductile and has lower resistance to thermal shock and fatigue than certain other heat-resistant superalloys.

Alloys S-495 and S-588 would be expected to be structurally unstable at temperatures typical of present day jet engine environments. These alloys, along with S-497, N-153, N-154 and N-156, all have such low chromium contents as to be limited to use at relatively low service temperatures.

In U.S. Pat. No. 5,077,006, it is disclosed that additions of small amounts of the six components, molybdenum, tungsten, columbium, titanium, zirconium and rare earth elements, increase hot strength of heat-resistant alloys. It is also noted that certain alloys disclosed in U.S. Pat. No. 5,077,006 incorporated additions of these elements in alloys containing up to about 25% Co. There is no suggestion in U.S. Pat. No. 5,077,006, however, that the inclusion of molybdenum is not desirable for improving hot strengths in alloys having more than about 15% Co. As described hereinbelow, however, I have now found that the inclusion of molybdenum is not desirable for improving hot strengths in alloys having more than about 15% Co. Furthermore, I have found that zirconium is not especially effective for improving the hot strength of cobalt-bearing, heat-resistant alloys having relatively low carbon contents.

SUMMARY OF THE INVENTION

It is therefore an object of this invention to provide fabricable, weldable, machinable, cobalt-bearing superalloys having excellent hot corrosion resistance and high hot strength for service to 2000° to 2100° F. It is a further object to provide such alloys which maintain hot corrosion resistance and high hot strength in the presence of gases containing sulfur and sulfur compounds. It is a further object to provide such alloys that provide increased service life without suffering thermal fatigue or thermal shock failure despite being subject to rapid and repeated thermal cycling.

Briefly, therefore, the invention is directed to a superalloy having improved hot strength at temperatures above about 1600° F. The superalloy consists essentially of about, by weight:

| | |
|---|---|
| Nickel | 18–29% |
| Cobalt | 14–24% |
| Chromium | 22–28% |
| Tungsten | 0.25–0.8% |
| Columbium | 0.25–0.7% |
| Carbon | 0.12–0.55% |
| Molybdenum | up to about 0.8% |
| Titanium | 0.05–0.35% |
| Silicon | up to about 2% |
| Manganese | up to about 2.5% |
| Nitrogen | up to about 0.25% |
| Zirconium | up to about 0.35% |
| Boron | up to about 0.04% |
| Rare earths | up to about 0.25% |
| Iron | essentially balance. |

The invention is further directed to a molybdenum-free superalloy consisting essentially of about, by weight:

| | |
|---|---|
| Nickel | 18–29% |
| Cobalt | 14–24% |
| Chromium | 22–28% |
| Tungsten | 0.25–0.8 |
| Columbium | 0.25–0.7% |
| Titanium | 0.05–0.35% |
| Carbon | 0.12–0.55% |
| Silicon | up to about 2% |
| Manganese | up to about 2.5% |
| Nitrogen | up to about 0.25% |
| Zirconium | up to about 0.35% |
| Boron | up to about 0.04% |
| Rare earths | up to about 0.25% |
| Iron | essentially balance. |

The invention is further directed to a superalloy which is especially resistant to sulfur-containing gases at temperatures between about 1600° F. and about 2000° F. consisting essentially of about, by weight:

| | |
|---|---|
| Nickel | 18–29% |
| Cobalt | 14–24% |
| Chromium | 22–28% |
| Tungsten | 0.25–0.8% |
| Columbium | 0.25–0.7% |
| Titanium | 0.05–0.35% |
| Carbon | 0.12–0.55% |
| Molybdenum | up to about 0.2% |
| Silicon | up to about 2% |
| Manganese | up to about 2.5% |
| Nitrogen | up to about 0.25% |
| Zirconium | up to about 0.35% |
| Boron | up to about 0.04% |
| Rare earths | up to about 0.25% |
| Iron | essentially balance. |

DETAILED DESCRIPTION OF THE INVENTION

In accordance with this invention, fully austenitic, high hot strength, cobalt-bearing superalloys are provided which have improved resistance to thermal shock, thermal fatigue, and hot gas corrosion, even in the presence of gases containing sulfur and sulfur compounds.

The essential components of the alloys of the invention are:

| | |
|---|---|
| NICKEL | 18–29% |
| COBALT | 14–24% |
| CHROMIUM | 22–28% |
| TUNGSTEN | 0.25–0.8% |
| COLUMBIUM | 0.25–0.7% |
| TITANIUM | 0.05–0.35% |
| MOLYBDENUM | up to about 0.8% |
| IRON | essentially balance |
| CARBON | 0.12–0.55% |

The nitrogen content may be as high as about 0.25% without detriment.

The alloys of the invention may also contain:

| | |
|---|---|
| SILICON | up to about 2% |
| MAGANESE | up to about 2.5% |
| ZIRCONIUM | up to about 0.35% |
| BORON | up to about 0.04% |
| RARE EARTHS | up to about 0.25% |

Preferable alloys of the invention are those having elements in the following ranges of proportions:

| | |
|---|---|
| NICKEL | 18–25% |
| COBALT | 16–22% |
| CHROMIUM | 22–26% |
| TUNGSTEN | 0.25–0.8% |
| COLUMBIUM | 0.25–0.7% |
| TITANIUM | 0.05–0.25% |
| CARBON | 0.12–0.45% |
| MAGANESE | 0.3 to 1.5% |
| SILICON | 0.3 to 1.5% |
| MOLYBDENUM | up to about 0.2% |
| ZIRCONIUM | up to about 0.35% |
| NITROGEN | up to about 0.25% |
| BORON | up to about 0.04% |
| RARE EARTH ELEMENTS | up to about 0.25% |
| NITROGEN | up to about 0.25% |
| IRON | essentially balance |

The alloys of the invention contain about 18% to about 29% Ni, preferably about 18% to about 25% Ni. It is preferred that nickel content be maintained below about 25% because above about 25% Ni is not essential to the invention and may be economically undesirable. The nickel content may be as low as about 18%, provided that the total of nickel plus cobalt does not fall below about 34%. The alloys of the invention contain about 14% to about 24% Co, preferably about 16% to about 22% Co. The cobalt content is maintained below about 24% because above about 24% Co is not essential to the invention and may be economically undesirable.

The molybdenum content of the alloys of the invention is specifically limited because I have found that the inclusion of molybdenum is deleterious for alloys intended for service in certain atmospheres and that molybdenum additions are not desirable for improving hot strength in alloys having more than about 15% Co. Molybdenum, as a microalloying element in general, is known to improve rupture life. I have found, however, that its role in improving rupture life is dominant at low temperatures and of decreasing importance at higher temperatures, where other microalloying elements such as Cb and Ti enhance rupture life. Due to the presence of cobalt in the range 14 to 24%, there is less of a need to enhance low temperature rupture life by microalloying, and deliberate additions of significant amounts of molybdenum may be foregone. The ability to forego molybdenum additions advantageously reduces the risk of low melting point molybdenum sulfide formation at high temperatures in the presence of sulfur-containing gases. These alloys are therefore molybdenum-free in that deliberate additions of a significant amount of molybdenum and the presence of molybdenum at a level which has been found to be deleterious are avoided. These alloys are especially resistant to failure in sulfur-containing environments and are intended for service in hotter and more corrosive environments than the higher molybdenum content alloys such as S-590 and N-155. The molybdenum content of the alloys of the invention is less than about 0.8%, preferably less than 0.1%, more preferably less than 0.05%, even more preferably less than 0.02%, and most preferably substantially undetectable. Although these alloys most preferably contain no deliberately added molybdenum, the use of certain scrap materials in their preparation is tolerable and may result in their containing up to about 0.04% Mo, and even up to about 0.2% Mo.

The chromium content does not exceed about 28% in the alloys of the inventions because, at the levels of nickel and cobalt herein, chromium is a ferrite former. Chromium content is therefore maintained below 28% in order to maintain austenitic matrix structural stability at the contemplated service temperatures. I have found that in alloys of the inventive compositions, chromium content should be at least about 22% to provide good oxidation resistance above about 1650° F. and up to about 2000° F. and 2100° F. Due in part to the high chromium content of these alloys, tungsten, columbium and titanium contents must be limited, since these elements, like chromium, are ferrite formers. It has been discovered that these elements are fully effective for providing maximum hot strength at temperatures in the range of 1500° F. to 2100° F. while safely avoiding ferrite formation when present in the following ranges of proportions: 0.25% to 0.8% for W, 0.25% to 0.7% for Cb and 0.05% to 0.35% for Ti.

Furthermore, I have found that zirconium is not especially effective for improving the hot strength in the alloys of the invention. As a result, these alloys exhibit improved hot strength though the zirconium content may, for various reasons, be less than 0.25%, less than 0.1%, less than 0.05%, less than 0.02%, or even substantially undetectable. While zirconium is not thought to be essential to develop hot strength in these alloys, it may be useful for increasing rupture life to some extent in certain compositions, and is in no instance detrimental in amounts up to about 0.35%.

Boron has been added to heat-resistant alloys for the purpose of improving hot strength and fabricability. In the alloys of the invention, Boron is not thought to be essential to improved hot strength, but at least has not been found to have any adverse effects in amounts at least to about 0.04%. These alloys may also contain up to about 2.5% Mn and up to about 2% Si for deoxidation purposes. The upper limit for silicon content is in part determined by its tendency to promote the formation of ferrite.

Air-melted alloys generally unavoidably contain nitrogen in amounts on the order of about 0.05% to about 0.13%. In the alloys of the invention, nitrogen content does not exceed about 0.25%, so that the formation of pinholes and porosity is prevented. In other superalloys, nitrogen has been deliberately incorporated as a partial substitute for carbon for alloy strengthening, but hot strengths at service temperatures above about 1600° F. have suffered where there has been a significant substitution of nitrogen for carbon. Such substitutions may be employed in the alloys of the invention, but nitrogen contents above about 0.25% are not tolerated.

The alloys of the invention contain between about 0.12% and 0.55% C. Carbon content above about 0.55%, and preferably above about 0.45%, is avoided because carbon tends to reduce the weldability, fabricability and resistance to thermal fatigue and shock of these alloys. The claimed alloys derive their hot strengths primarily through the formation of carbides of tungsten, columbium and titanium, and therefore a minimum carbon content of about 0.12% is required.

Though rare earth elements have been added to heat-resistant alloys in part for the purpose of increasing scale resistance, I have found that scale resistance is imparted to the alloys of the invention by the formation of tight, adherent oxide coatings without rare earth additions. Rare earth additions have been found to provide only modest improvements in the scale resistance of the alloys of the invention. Furthermore, rare earths have been found to be detrimental to ductility, but may be tolerated in alloys of the invention in an amount such that the total combined rare earth component is up to about 0.25% without severe reduction in room temperature or high temperature ductilities. Though the total combined rare earth component is tolerable up to about 0.25%, it is preferably maintained below about 0.1%, more preferably below 0.04%, and most preferably below about 0.02%.

The following examples illustrate the invention.

EXAMPLE 1

One-hundred pound heats of several different alloys of the invention were prepared in accordance with the invention. Well-risered keel blocks were cast from each heat. The compositions of these alloys are set forth in Table II, with the balance in each case being essentially iron.

TABLE II

| COMPOSITION BY WEIGHT PERCENTAGES OF SEVERAL ALLOYS OF THE INVENTION | | | | | | | | | | | |
|---|---|---|---|---|---|---|---|---|---|---|---|
| ALLOY NUMBER | C | Ni | Co | Cr | W | Cb | Ti | Zr | Mn | Si | B |
| H-970 | .38 | 23.1 | 18.1 | 22.9 | .50 | .48 | .23 | .24 | .63 | .54 | — |
| H-973 | .45 | 22.8 | 18.9 | 23.1 | .51 | .46 | .22 | .19 | .63 | .57 | .03 |
| H-979 | .46 | 21.8 | 21.0 | 23.7 | .52 | .44 | .24 | .21 | .66 | .59 | — |
| H-980 | .44 | 28.3 | 14.5 | 26.5 | .64 | .43 | .21 | .18 | .64 | .78 | — |
| H-981 | .44 | 24.3 | 21.1 | 22.3 | .68 | .32 | .18 | — | .58 | .72 | — |
| H-983 | .33 | 20.8 | 21.2 | 22.8 | .52 | .38 | .16 | — | .56 | .62 | — |

Standard one-quarter inch diameter stress rupture test bars were machined for each heat. These bars were tested in air on standard cantilever load type creep test frames at various loads and at temperatures of 1600° F., 1700° F., 1800° F., 1900° F., and 2000° F. until rupture occurred. The results of these tests are set forth in Table III.

TABLE III

| RUPTURE TIME IN HOURS AT VARIOUS TEMPERATURES AND LOADS | | | | | |
|---|---|---|---|---|---|
| ALLOY DESIGNATION | 9000 PSI 1600° F. | 7000 PSI 1700° F. | 5000 PSI 1800° F. | 4000 PSI 1900° F. | 3000 PSI 2000° F. |
| H-970 | 2312.4 | 808.1 | 361.0 | 286.7 | 134.2 |
| H-973 | 5168.2 | — | 665.3 | 358.9 | 151.3 |
| H-979 | 3659.6 | 1305.4 | 858.3 | — | 181.4 |
| H-980 | 3119.3 | 1855.1 | 1488.7 | — | 186.7 |
| H-981 | 3824.1 | 502.6 | 832.4 | 425.8 | — |
| H-983 | 487.2 | 516.4 | 265.9 | 282.5 | — |

These values were converted by use of the familiar Larson-Miller parameter to 1000-hour rupture stress values; the mean value at each temperature is set forth in Table IV.

TABLE IV

| 1000-HOUR RUPTURE STRESS, PSI | | | | | |
|---|---|---|---|---|---|
| TEMPERATURE DEGREES F | ALLOYS OF THE INVENTIONS | S-590 | N-155 | HA556 | HR-120 |
| 1600° F. | 11,000 | 9,000 | 8,700 | 7,700 | 8,200 |
| 1700° F. | 7,500 | 5,600 | 5,700 | 5,500 | 5,100 |
| 1800° F. | 4,900 | 3,100 | 3,600 | 2,900 | 3,400 |
| 1900° F. | 3,100 | 1,650 | 2,000 | 1,650 | 2,100 |
| 2000° F. | 1,800 | 920 | 1,200 | 950 | 1,300 |
| NOMINAL ANALYSIS | | | | | |
| ELEMENT | ALLOYS OF THE INVENTIONS | S-590 | N-155 | HA556 | HR-120 |
| Ni | 22 | 20 | 20 | 20 | 37 |
| Co | 18 | 20 | 20 | 18 | 2 |
| Cr | 25 | 20 | 21 | 22 | 25 |
| Mo | — | 4 | 3 | 3 | 2.5 MAX |
| W | .5 | 4 | 2.5 | 2.5 | 2.5 MAX |
| Cb | .5 | 4 | 1 | — | .7 |
| Ti | .2 | — | — | — | — |
| Ta | — | — | — | .6 | — |

For comparison purposes, values up through 1900° F. for the N-155 and S-590 alloys discussed above were taken from the published literature and included in Table IV. Their values at 2000° F. were estimated by extrapolation employing the Larson-Miller parameter.

Also provided in Table IV are stress rupture data for Haynes Alloy No. 556 (HA 556). HA 556 was derived from N-155 in an effort to improve oxidation resistance. It should be noted, however, that HA 556 has a high Mo content, rendering it less resistant to corrosion in the presence of sulfur-containing gases.

Table IV also presents published stress rupture data for recently developed alloy HR-120. These data reveal that HR-120 has better hot gas corrosion resistance than prior art alloys S-590, N-155 and HA 556. Table IV provides the nominal analyses of the compared alloys, revealing that HR-120 has the same chromium content as alloys of the invention, which is greater than the chromium content of S-590, N-155 and HA 556. Despite the relative chromium content, however, the hot strength of HR-120 is significantly lower than the hot strength of alloys of the invention at the temperatures tested.

The higher strength of the alloys of the invention as indicated in Table IV provides the additional advantage of permitting the designing of articles having thinner sections using these alloys. The use of thinner sections in a given component can be expected to reduce the component's vulnerability to thermal fatigue as thermal gradients and thermal stresses are reduced. The resistance to thermal fatigue of articles manufactured from alloys of the invention would therefore be expected to be further enhanced over articles manufactured from S-590, N-155, HA 556 or HR-120, even though these latter alloys were formulated to provide high resistance to failure by thermal fatigue.

EXAMPLE 2

The stress rupture test bars of Example 1 tested at 1900° F. and 2000° F. were sectioned, polished and examined for oxide coating. In all test bars of the alloys of the invention the coating was observed at 100X magnification to be very thin, tight and adherent. If the alloys were unsuitable for service at temperatures up to 1900° F. or 2000° F., in contrast, they would be expected to show, loose, heavy scale after stress-rupture testing in air on these creep frames.

EXAMPLE 3

The heavy portion of the keel blocks made for each test alloy of Example 1 measured about three inches by four inches by six inches after the test bars had been cut off. The face adjacent to the cut-off test bar legs of a block for each test alloy of the invention was ground smooth on a heavy abrasive grinding wheel. Circular weld beads were then welded on the ground face of each of these along with a connecting cross within each circle of approximately two inches diameter.

These welds were made using Type 310 high carbon stainless steel bare wire through a metal-inert-gas welding machine at 20 volts and 200 amperes direct current. This procedure was repeated with one-eighth inch diameter coated stick welding rods on each block. All welds and areas adjacent to the weld beads were examined at 10×magnification for evidence of hair line cracking. No cracks were observed in any of the welds or weld areas of any of the test alloys of the invention, thus indicating the weldability of these alloys.

From these examples it is evident that alloys of the invention have higher hot strengths above 1500° F. than the prior art superalloys of this type. The alloys of the invention have reduced molybdenum contents and increased chromium contents, resulting in superior hot gas corrosion, even in sulfur-containing environments. It is also shown that these alloys are able to tolerate service temperatures up to 2000° F. and 2100° F.

It is also evident that these alloys have hot strengths that are at least as high as the best SFSA-ACI H-type alloys at least to 1850° F. and hot strengths superior to the best such alloys up to 1750° F., either of the standard grades or of all those grades improved under the provisions of U S. Pat. No. 5,077,006.

The alloys of the invention therefore provide hot strengths and corrosion resistance superior to the alloys of a class that have been consistently used for similar applications over several decades.

In view of the above, it will be seen that the several objects of the invention are achieved.

Although specific examples of the present invention are provided herein, it is not intended that they are exhaustive or limiting of the invention. These illustrations and explanations are intended to acquaint others skilled in the art with the invention, its principles, and its practical application, so that others skilled in the art may adapt and apply the invention in its numerous forms, as may be best suited to the requirements of a particular use.

What is claimed is:

1. A superalloy having improved hot strength at temperatures above about 1600° F. consisting essentially of about, by weight:

| | |
|---|---|
| Nickel | 18–29% |
| Cobalt | 14–24% |
| Chromium | 22–28% |
| Tungsten | 0.25–0.8% |
| Columbium | 0.25–0.7% |
| Carbon | 0.12–0.55% |
| Titanium | 0.05–0.35% |
| Molybdenum | up to about 0.05% |
| Silicon | up to about 2% |
| Manganese | up to about 2.5% |
| Nitrogen | up to about 0.25% |
| Zirconium | up to about 0.35% |
| Boron | up to about 0.04% |
| Rare earths | up to about 0.25% |
| Iron | essentially balance. |

2. The superalloy of claim 1 wherein:
Molybdenum: less than 0.02%.
3. The superalloy of claim 2 wherein:
Molybdenum: about zero.
4. The superalloy of claim 1 wherein:
Cobalt: 16–22%.
5. The superalloy of claim 1 wherein:
Nickel: 18–25%.
6. The superalloy of claim 1 wherein:
Chromium: 22–26%.
7. The superalloy of claim 1 wherein:
Carbon: 0.12–0.45%.
8. The superalloy of claim 1 wherein:
Zirconium: less than 0.05%.
9. The superalloy of claim 8 wherein:
Zirconium: less than 0.02%.
10. The superalloy of claim 9 wherein:
Rare earths: less than 0.1%.
11. The superalloy of claim 10 wherein:
Rare earths: less than 0.04%.
12. A molybdenum-free superalloy consisting essentially of about, by weight:

| | |
|---|---|
| Nickel | 18–29% |
| Cobalt | 14–24% |
| Chromium | 22–28% |
| Tungsten | 0.25–0.7% |
| Columbium | 0.25–0.7% |
| Titanium | 0.05–0.35% |
| Carbon | 0.12–0.55% |
| Silicon | up to about 2% |
| Manganese | up to about 2.5% |
| Nitrogen | up to about 0.25% |
| Zirconium | up to about 0.35% |
| Boron | up to about 0.04% |
| Rare earths | up to about 0.25% |
| Iron | essentially balance. |

13. The superalloy of claim 12 wherein:
Cobalt: 16–22%.
14. The superalloy of claim 12 wherein:
Nickel: 18–25%.
15. The superalloy of claim 12 wherein:
Chromium: 22–26%.
16. The superalloy of claim 12 wherein:
Carbon: 0.12–0.45%.
17. The superalloy of claim 12 wherein:
Zirconium: less than 0.05%.
18. The superalloy of claim 12 wherein:
Rare earths: less than 0.04%.
19. A superalloy consisting essentially of about, by weight:

| | |
|---|---|
| Nickel | 18–25% |
| Cobalt | 16–22% |
| Chromium | 22–26% |
| Tungsten | 0.25–0.8% |
| Columbium | 0.25–0.7% |
| Titanium | 0.05–0.25% |
| Carbon | 0.12–0.45% |
| Silicon | 0.3–1.5% |
| Manganese | 0.3–1.5% |
| Molybdenum | up to about (0.2%) 0.05% |
| Nitrogen | up to about 0.25% |
| Zirconium | up to about 0.35% |
| Boron | up to about 0.04% |
| Rare earths | up to about 0.25% |
| Iron | essentially balance. |

* * * * *